US006186758B1

(12) United States Patent
Shaw

(10) Patent No.: US 6,186,758 B1
(45) Date of Patent: Feb. 13, 2001

(54) MULTI-ROTOR HELICAL-SCREW COMPRESSOR WITH DISCHARGE SIDE THRUST BALANCE DEVICE

(76) Inventor: David N. Shaw, 200 D. Brittany Farms Rd., New Britain, CT (US) 06053

( * ) Notice: Under 35 U.S.C. 154(b), the term of this patent shall be extended for 0 days.

(21) Appl. No.: 09/023,271

(22) Filed: Feb. 13, 1998

(51) Int. Cl.[7] ..... F04C 18/00

(52) U.S. Cl. ..... 418/203; 418/97; 418/104; 384/303; 384/907.1; 508/108

(58) Field of Search ..... 418/203, 97, 104; 508/108; 384/303, 99, 494, 492, 907.1

(56) References Cited

U.S. PATENT DOCUMENTS

| | | | | |
|---|---|---|---|---|
| 2,481,527 | * | 9/1949 | Nilson | 418/197 |
| 3,097,359 | * | 7/1963 | Cowles et al. | 418/203 |
| 3,161,349 | * | 12/1964 | Schibbye | 418/203 |
| 3,314,597 | * | 4/1967 | Schibbye | 418/203 |
| 3,738,719 | * | 6/1973 | Langner | 308/189 A |
| 3,922,114 | * | 11/1975 | Hamilton et al. | 417/366 |
| 3,932,073 | * | 1/1976 | Schibbey et al. | 418/97 |
| 4,147,475 | * | 4/1979 | Shoop et al. | 417/310 |
| 4,492,542 | * | 1/1985 | Zimmen | 418/46 |
| 4,781,553 | * | 11/1988 | Nomura et al. | 418/104 |
| 4,878,820 | * | 11/1989 | Doi et al. | 418/203 |
| 5,741,762 | * | 4/1998 | Kahlman | 508/108 |
| 5,816,055 | | 10/1998 | Ohman . | |
| 6,050,797 | * | 4/2000 | Zhong | 418/203 |

* cited by examiner

*Primary Examiner*—Thomas Denion
*Assistant Examiner*—Thai-Ba Trieu
(74) *Attorney, Agent, or Firm*—Cantor Colburn LLP

(57) ABSTRACT

A compressor in accordance with the present invention includes a male rotor which is axially aligned with and in communication with two female rotors. The compressor includes a housing and a thrust balance configuration. The thrust balance configuration includes a thrust balance disc mounted to a male rotor shaft in a discharge housing of the compressor. The thrust balance disc is exposed to fluid from the compressor at high pressure. The outside diameter of the thrust balance is sized to provide sufficient area to react thrust loads produced by the first rotor. The thrust balance configuration serves to balance the thrust loads imparted on the male rotor and allows for full axial discharge porting.

26 Claims, 3 Drawing Sheets

MULTI-ROTOR HELICAL-SCREW COMPRESSOR WITH DISCHARGE SIDE THRUST BALANCE DEVICE

BACKGROUND OF THE INVENTION

The present invention relates to helical screw type compressors. More specifically, the present invention relates to a multi-screw compressor having, e.g., a male rotor and at least two female rotors.

Helical type compressors are well known in the art. One such helical compressor employs one male rotor axially aligned with and in communication with one female rotor. The pitch diameter of the female rotor is greater than the pitch diameter of the male rotor. Typically, the male rotor is the drive rotor, however compressors have been built with the female rotor being the drive rotor. The combination of one male rotor and one female rotor in a compressor is commonly referred to as a twin screw or rotor, such is well know in the art and has been in commercial use for decades. An example of one such twin rotor commonly employed with compressors in the HVAC (heating, ventilation and air conditioning) industry is shown in FIG. 1 herein, labeled prior art. Referring to FIG. 1 herein, a cross sectional view of a male rotor 10 which drives an axially aligned female rotor 12 is shown. Male rotor 10 is driven by a motor, not shown, as is well known. Male rotor 10 has four lobes 14–17 with a 300° wrap and female rotor 12 has six flutes 18–23 with a 200° wrap. The resulting gap between the male and female rotors requires oil to be introduced into the compression area for sealing, however, the oil also provides cooling and lubricating, as is well known. However, the introduction of this oil requires the use of an oil separation device, to separate the oil from the refrigerant being compressed in HVAC compressors. The primary benefit of the twin rotor configuration is the low interface velocity between the male and female rotors during operation. However, the twin rotor configuration is not balanced and therefore incurs large radial bearing loads and thrust loads. The obvious solution to alleviating the bearing load problem would be to install sufficiently sized bearings. This is not a feasible solution, since the relative diameters of the rotors in practice result in the rotors being too close together to allow installation of sufficiently sized bearings.

The prior art has addressed this problem, with the introduction of compressors employing 'so-called' single screw technology. Referring to FIGS. 2 and 3 herein, labeled prior art, a drive rotor 24 with two opposing axially perpendicular gate rotors 26 and 28 is shown. Rotor 24 is driven by a motor, not shown, as is well known. Rotor 24 has six grooves 30 and each gate rotor 26, 28 has eleven teeth 32, 34, respectively, which intermesh with grooves 30. The gate rotors 26 and 28 are generally comprised of a composite material which allows positioning of the gate rotor at a small clearance from the drive rotor. This clearance is small enough that the liquid refrigerant itself provides sufficient sealing, the liquid refrigerant also provides cooling and lubrication. The rearward positioning of gate rotors 26 and 28 and the positioning on opposing sides of drive rotor 24, (1) allows equalizing suction of pressure at both ends of rotor 24 thereby virtually eliminating the thrust loads encountered with the above described twin screw system and (2) balances the radial loading on rotor 24 thereby minimizing radial bearing loads. However, the interface velocity between the gate rotors and the drive rotor are very high. Accordingly, a common problem with this system is the extensive damage suffered by the rotors when lubrication is lost, due to the high interface velocities of the rotors.

One method of overcoming these deficiencies of the prior art is presented in U.S. Pat. No. 5,642,992 commonly assigned to this application. The compressor in '992 includes a male rotor which is axially aligned with and in communication with at least two female rotors. The male rotor is driven by a motor, in other words the male rotor is the drive rotor. The male rotor has a plurality of lobes which intermesh with a plurality of flutes on each of the female rotors. The pitch diameters of the female rotors are now less than the pitch diameter of the male rotor.

The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, however, the liquid refrigerant also provides cooling and lubrication.

The positioning of the female rotors on opposing sides of the male rotor balances the radial loading on the male rotor thereby minimizing radial bearing loads. Further, due to a larger diameter male drive rotor as compared to the male drive rotor in the prior art twin screw compressors, and therefore, additional distance between the rotors, any female radial bearing stress can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced.

The compressor includes a housing having an inlet housing portion, a main housing portion and a discharge housing portion. An induction side plate and a discharge side plate are mounted on the male rotor. The outside diameter of the induction side plate is equal to the root diameter of the male rotor. It will be appreciated that in order to properly balance the thrust in compressor 90 the diameter of the balance disc 205 is generally about the same as represented by dimension "B" in FIG. 5A. These plates serve two purposes, to secure the male rotor components and to equalize suction pressure at both ends of the male rotor, thereby virtually eliminating the thrust loads encountered with the prior art twin screw compressors. It will be appreciated that the discharge plate blocks the axial port area of the male rotor which results in a reduction in overall discharge port area.

SUMMARY OF THE INVENTION

The above-discussed and other drawbacks and deficiencies of the prior art are overcome or alleviated by the multi-rotor compressor of the present invention. In accordance with the present invention, the compressor includes a male rotor which is axially aligned with and in communication with at least two female rotors. The male rotor is driven by a motor, in other words the male rotor is the drive rotor. The male rotor has a plurality of lobes which intermesh with a plurality of flutes on each of the female rotors. The pitch diameters of the female rotors are less than the pitch diameter of the male rotor.

The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, however, the liquid refrigerant also provides cooling and lubrication.

The positioning of the female rotors on opposing sides of the male rotor balances the radial loading on the male rotor thereby minimizing radial bearing loads. Further, due to a larger diameter male drive rotor as compared to the male drive rotor in the prior art twin screw compressors, and therefore, additional distance between the rotors, any female radial bearing stress can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced.

A thrust balance device is disposed on the male rotor shaft at the discharge end. The thrust balance device is mounted on the male rotor within the discharge housing of the compressor and is exposed to fluid from the compressor at high pressure. The thrust balance configuration is sized to sufficiently balance the thrust loads imparted on the male rotor and allows for full axial discharge porting as the outside diameter of the thrust balance device is generally about or less than the root diameter of the male rotor, as shown by FIGS. 4 and 5A–5C.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
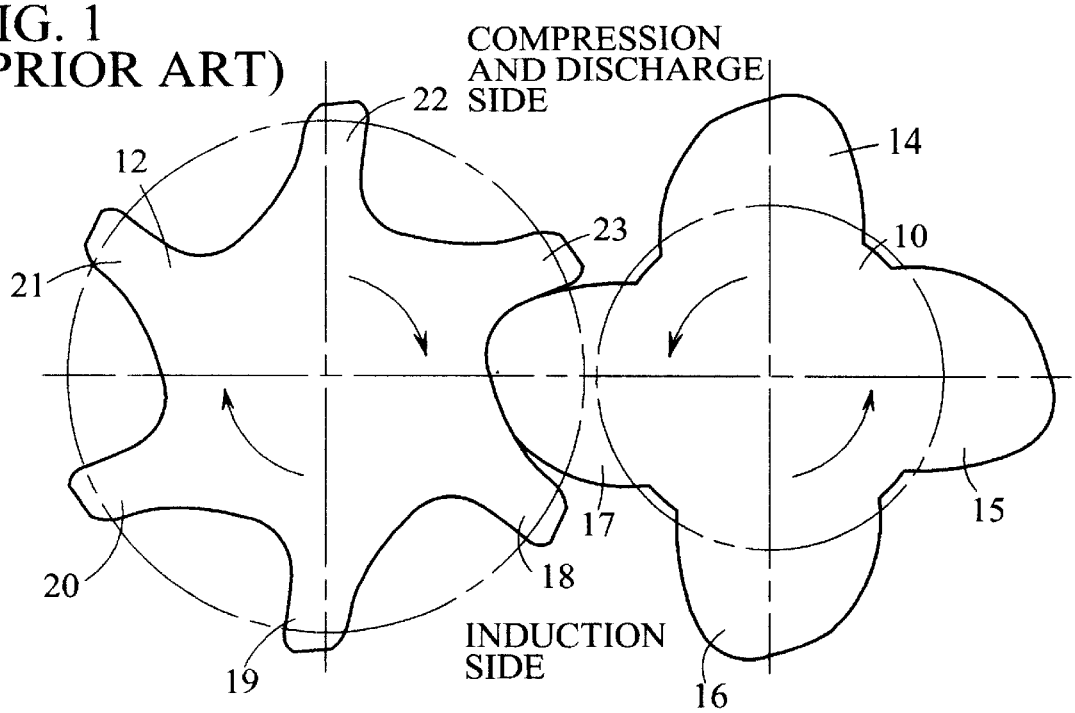
FIG. 1 (PRIOR ART)
FIG. 1 is a diagrammatic cross sectional view of a twin screw or rotor configuration in accordance with the prior art.
Figure 2:
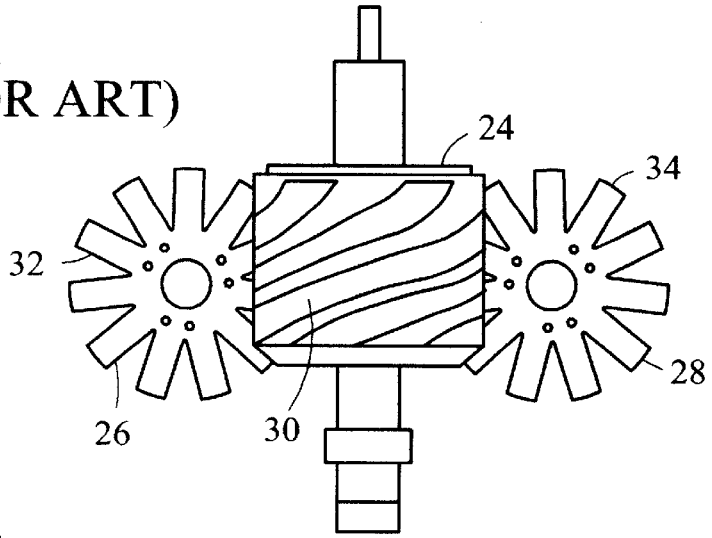
FIG. 2 (PRIOR ART)
FIG. 2 is a diagrammatic top view of a single screw configuration in accordance with the prior art.
Figure 3:
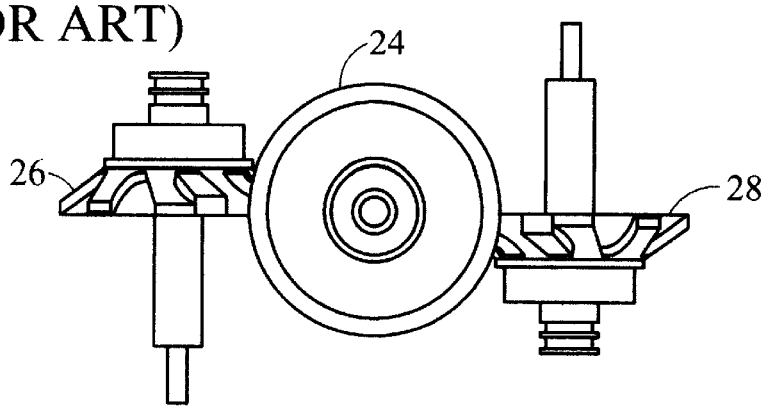
FIG. 3 (PRIOR ART)
FIG. 3 is a diagrammatic end view of the single screw configuration of FIG. 2.
Figure 4:
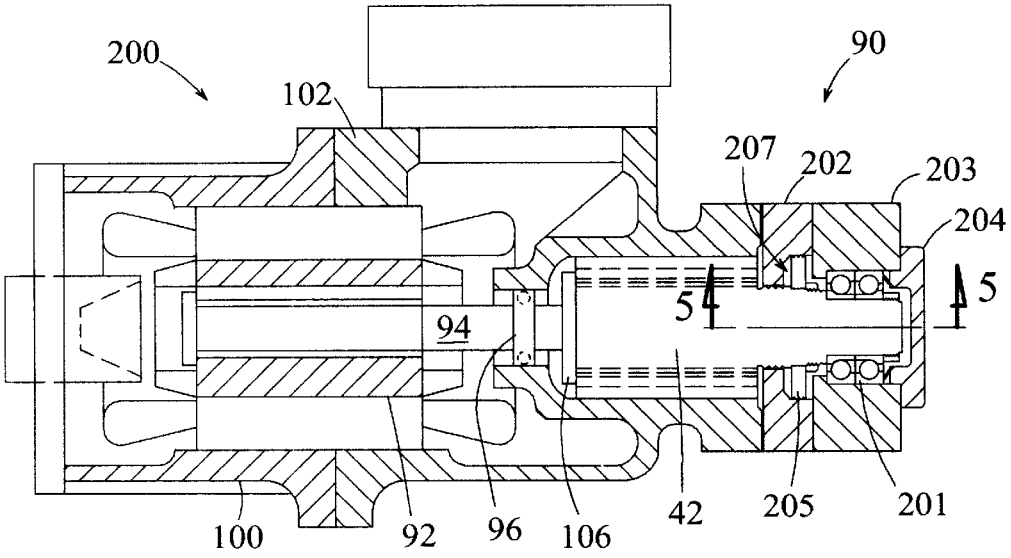
FIG. 4 is a diagrammatic cross sectional view of a multi-rotor compressor and hermetically sealed motor configuration in accordance with the present invention.

Referring to FIG. 4, a cross sectional view of a hermetically sealed motor/compressor system in accordance with the present invention is generally shown at 200. A male rotor 42 is axially aligned with and in communication with female rotors (not shown). Male rotor 42 is driven by a hermetically sealed motor 92.

As demonstrated in the prior art, the positioning of the female rotors on opposing sides of male rotor 42 balances the radial loading on male rotor 42 thereby minimizing radial bearing loads. Also, due to larger diameter male drive rotor as compared to the male drive rotor in the prior art twin screw compressors and therefore the additional distance between the rotors, any radial bearing stress can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced. The low interface velocity results in minimal sliding action at the pitch band interface of the rotors.

A bearing 201 is mounted on shaft 94 near the discharge end of compressor 90 to react any remaining radial bearing loads imparted to the shaft. Bearing 201 is shown as a double row angular contact ball type. Compressor 90 further comprises a housing having a discharge housing portion 202, a bearing housing portion 203, and end cap 204. Discharge housing portion 202 of compressor 90 comprises porting which communicates with the radial and axial port areas of the rotors, as is well known in the art. Also disposed within discharge housing portion 202 is thrust balance disc 205 mounted to shaft 94.

Figure 5A:
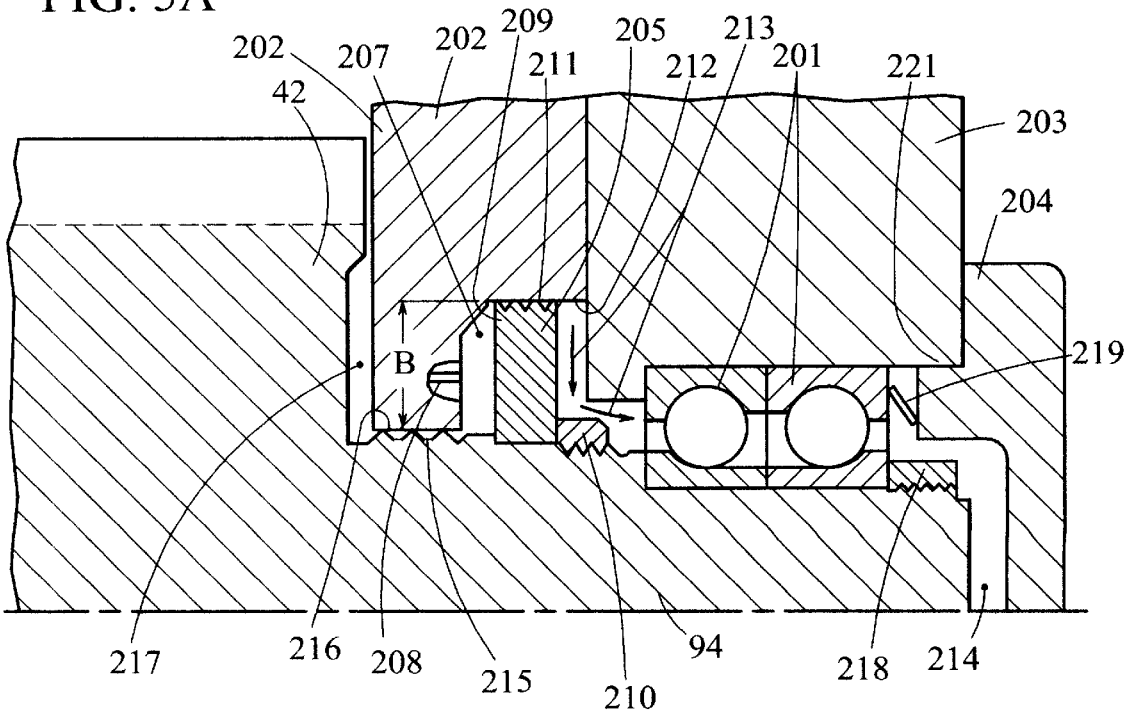
FIG. 5A is a diagrammatic cross sectional view of the multi-rotor compressor of FIG. 4 taken substantially along lines 5—5 showing a discharge side thrust balance configuration in accordance with the present invention.

Refrigerant at high pressure (represented by arrow 207) is introduced into the discharge housing 202 through a port (not shown). With reference to FIG. 5A high pressure refrigerant 207 from port 208 acts on face 209 of thrust balance disc 205 counteract the imbalance force created by the large male rotor as described herein above. Thrust balance disc 205 is fixed axially onto shaft 94, or alternatively an integral portion of male rotor 42, by lock ring 210 threaded onto shaft 94 as is well known in the industry. It will be appreciated that in order to properly balance the thrust in compressor 90 the diameter of the balance disc 205 is generally represented by dimension "B" in FIG. 5A. It will also be appreciated that any thrust load imbalance remaining will be reacted by double row angular contact bearing 201. In operation of compressor 90 the condensing pressure starts low and builds as does the liquid line pressure of refrigerant 207 introduced at port 202. Balance piston 205 eliminates the need for the discharge side plate of the prior art during normal operation and allows for full axial area discharge.

Balance disc 205, which rotates with male rotor 42 and shaft 94, further comprises a labyrinth seal 211 which provides a small clearance between the balance disc and wall 212 of discharge housing 100. The small clearance allows refrigerant 207 to leak past balance disc 205. As the refrigerant leaks past labyrinth 211 it expands to lower pressure represented by arrows 213 to provide cooling and lubrication to bearing 201 and is exhausted through passage 214 and reintroduced into the compressor 90 at a low pressure port (not shown). Similarly labyrinth seal 215 provides a dynamic seal between the male rotor 42 and wall 216 to maintain high pressure to react the axial loads between reaction face 209 and wall 216 of the discharge housing 202. During operation, bearing 201 and passage 214 are maintained at a relatively low pressure, compared to high pressure refrigerant 207, providing a pressure differential which allows refrigerant to flow from port 208 past labyrinth seal 211 through bearing 201 and into passage 214. Similarly, a pressure differential exists between port 208 and the low pressure area 217 of male rotor 42 which allows high pressure refrigerant 207 to leak past labyrinth 215 and refrigerant 213 to enter low pressure area 217 of compressor 90. It will be appreciated that bearing 201 is of a class of bearings requiring little lubrication such as, for example, hybrid ceramic bearings. Prior art bearings require a higher level of lubrication than is generally considered practical for use with the present invention. Bearing 201 is disposed within separate bearing housing 203, which allows installation of disc 205, and held in place by bearing lock nut 218 and spring washer 219 as is well known in the industry. End plate 204 biases the spring washer 219 and seals passage 214 from the atmosphere.

Figure 5B:
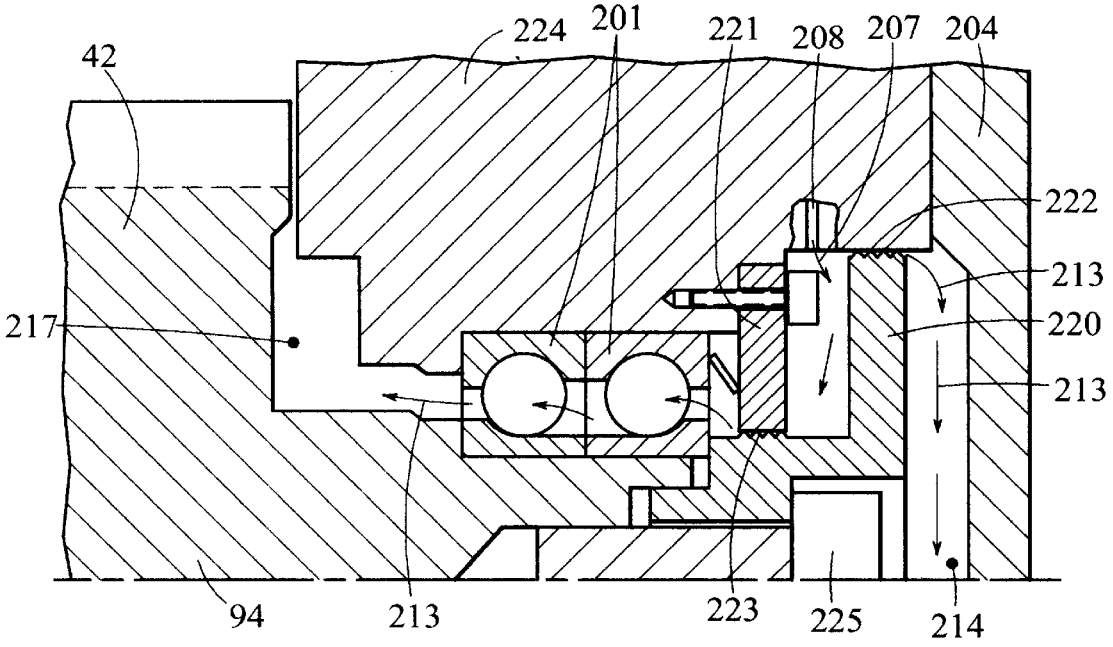
FIG. 5B is a diagrammatic cross sectional view of the multi-rotor compressor of FIG. 4 taken substantially along lines 5—5 showing a discharge side thrust balance configuration in accordance with the present invention.

Now with reference to FIG. 5B, there is shown an alternative embodiment of a thrust balance device in accordance with the present invention. In this particular embodiment thrust balance disc 220 functions similar to that described herein above in that high pressure refrigerant 207 enters from port 208 to react against balance disc 220 and annular disc 221 to react the axial loads produced by male rotor 42. A portion of high pressure refrigerant 207 leaks past labyrinth seal 222 and into passage 214 while the remainder of high pressure refrigerant 207 leaks past labyrinth seal 223 expands into low pressure, cooler, refrigerant 213 and cools and lubricates bearing 201 and continues on to flow into low pressure area 217 of compressor 90. An advantage to this particular embodiment over that shown in FIG. 5A is the reduction in parts and assembly steps as there is an integral discharge/bearing housing 224 and thrust balance disc 220 incorporates several features. For instance both labyrinth seals 222, 223 are disposed on the disc and the disc also retains the inner race of bearing 201. In the embodiment shown disc 220 is mounted to shaft 94 by bolt 225. It is contemplated that there may be a plurality of bolts attaching disc 220 to shaft 94 as well as being directly threadably engaged onto an externally threaded portion of shaft 94 (not shown).

Figure 5C:
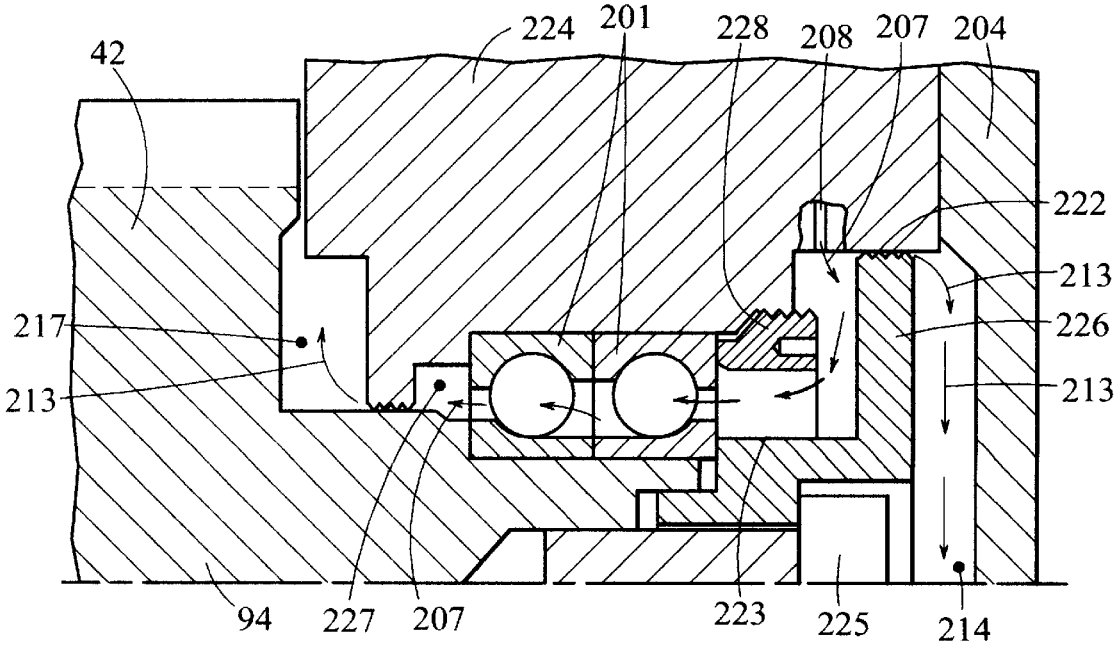
FIG. 5C is a diagrammatic cross sectional view of the multi-rotor compressor of FIG. 4 taken substantially along lines 5—5 showing a discharge side thrust balance configuration in accordance with the present invention.

Referring to FIG. 5C there is shown another embodiment of a thrust balance device in accordance with the present invention. This particular embodiment is similar to that described herein above and shown in FIG. 5B with the biggest difference being that the bearing 201 is flooded with high pressure refrigerant 207 instead of expanded low pressure refrigerant 213. In this particular configuration high pressure refrigerant 207 acts between thrust disc 226 and the entire bearing cavity ending at the labyrinth teeth adjacent wall 227 of discharge/bearing housing 224 to react the axial loads imparted to the bearing 201 from the large male rotor 42. In addition the outer race of bearing 201 is mounted within discharge/bearing housing 224 by spanner type bearing block 228 as is well known in the industry.

Although the present invention is shown in relation to a hermetically sealed motor/compressor configuration with refrigerant as the operating fluid it is only by way of example. It is contemplated that the present invention may also, by way of example, comprise a discharge side thrust balance device for an open type air multi-rotor compressor driven by an externally mounted motor or an internally mounted motor (not shown). To balance the thrust load, in an open type air compressor, water is introduced through ports reacts against a thrust balance disc similar to that described herein above. The compressor is sealed, cooled and lubricated by water and should be noted that the double row angular contact bearing is maintained at high pressure and filled with water. The discharge side plate of the prior art is no longer needed and axial discharge of the male rotor is thereby permitted.

Further, while the above described embodiment has been described with only two female rotors, it is within the scope of the present invention that two or more female rotors may be employed with a single drive male rotor. The female rotors are distributed evenly about the male rotor to balance radial forces against the male rotor as hereinbefore described. In addition, while the embodiment shown in FIG. 4 is directed toward a liquid refrigerant type compressor and while the embodiment shown in FIG. 5 is directed toward an air type compressor, it is within the scope of the present invention that either embodiment is suitable for either application and is also applicable in other helical type compressors, e.g., compressors with working fluids such as helium, air and ammonia. Moreover, the multi-rotor compressor of the present invention may be extremely well suited for oil-less air compression.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A helical-screw rotary compressor comprising:

compressor rotors comprising a first rotor and at least one additional rotor, said first rotor disposed within a compressor housing on a shaft, said at least one additional rotor engaging said first rotor and being driven by said first rotor; and a thrust balance configuration comprising a thrust balance disc disposed on said shaft within a thrust balance chamber in a housing, said disc comprising a dynamic seal at an outer perimeter of said thrust balance disc thereby dividing said thrust balance chamber into a high pressure zone for a fluid at high pressure and a low pressure zone for a fluid at low pressure, said high pressure zone having sufficient volume to permit fluid pressure of said fluid to become evenly distributed against said thrust balance disc, said thrust balance disc having a total area sufficient to react a thrust produced by said first rotor without requiring fluid on either side of said disc being greater than a discharge pressure of said compressor.

2. The compressor of claim 1 wherein said housing comprises a thrust balance inlet port disposed therein and in communication with said high pressure zone.

3. The compressor of claim 2 wherein said thrust balance configuration includes a seal provided between said shaft and said housing and disposed between said inlet port and said first rotor.

4. A helical-screw rotary compressor having a discharge end and an opposite end, said compressor comprising:

a compressor housing;

a generally cylindrical shaft rotationally mounted within said compressor housing by at least two bearings;

compressor rotors comprising a first rotor and at least one additional rotor, said first rotor disposed on said shaft proximate said discharge end within said compressor housing, said at least one additional rotor engaging said first rotor and being driven by said first rotor, a thrust balance configuration comprising a thrust balance disc disposed on said shaft within a discharge housing proximate said discharge end, said disc comprising a dynamic seal at an outer perimeter of said thrust balance disc thereby dividing said thrust balance chamber into a high pressure zone for a fluid at high pressure and a low pressure zone for a fluid at low pressure, said high pressure zone having sufficient volume to permit fluid pressure of said fluid at high pressure to become evenly distributed against said thrust balance disc, said thrust balance disc having a total area sufficient to react a thrust produced by said first rotor without requiring fluid pressure greater than a discharge pressure downstream of said compressor; and said discharge housing including an inlet port in communication with said high pressure zone.

5. The compressor of claim 4 further comprising:

a seal provided between said shaft and said discharge housing and disposed on said shaft between said inlet port and said first rotor of said compressor.

6. The compressor of claim 4 wherein:

said disc includes a generally cylindrical shoulder;

said shoulder includes a labyrinth seal disposed on an outer diameter between said shoulder and said discharge housing; and said inlet port disposed between said discharge end and said seal.

7. The compressor of claim 4 wherein said disc has an outside diameter about the same as the crest diameter of said first rotor.

8. The compressor of claim 4 further comprising a drive motor in communication with said shaft for driving said first rotor.

9. The compressor of claim 4 further comprising:

a drive motor disposed on said shaft for driving said first rotor; and said shaft rotatably mounted on a first bearing disposed in said discharge end, a second bearing disposed between said motor and said first rotor, and a third bearing disposed in said opposite end.

10. The compressor of claim 9 wherein at least one of said bearings is comprised of a ceramic hybrid bearing.

11. A helical-screw rotary type compressor for compressing a working fluid comprising:

compressor rotors comprising a first rotor and at least one additional rotor;

a compressor housing, said compressor housing providing an enclosed annular space formed around a shaft that is fixed to or integral with said first rotor, said enclosed annular space having a port filling said enclosed annular space with said fluid at said high pressure, the enclosed annular space being bound on a first side by a first wall and on a second side by a second wall, the first wall being fixed to or integrally formed with said shaft and the second wall being fixed to or integrally formed with the housing, said first wall having a first and second side, the first side facing the annular space and the second side opposite the first side facing a low pressure region, the first wall further having a dynamic seal between the first and second sides to maintain a pressure differential between said enclosed annular space and said low pressure region; the low pressure region having a port leading to a source of the fluid at low pressure; whereby the fluid at high pressure acting on a first side of the first wall and the fluid at low pressure acting on the second side of the first wall creates a net axial load on the first wall and therefore the shaft to which it is fixed; said first wall having an area sufficient to balance a thrust imposed on the shaft by said first rotor when said pressure differential is no greater than a difference in pressure between a high pressure side and low pressure side of said compressor.

12. The helical-screw rotary type compressor set forth in claim 11 wherein said first wall is sized to provide sufficient thrust to balance and counteract thrust caused by compressing action of the rotor without requiring said pressure in said annular space to be greater than an outlet pressure of said compressor.

13. The helical-screw rotary type compressor set forth in claim 11 wherein said at least one additional rotor is in engagement with and is driven by said first rotor.

14. The helical-screw rotary type compressor set forth in claim 13 wherein said at least one additional rotor comprises two additional rotors disposed substantially 180 degrees from each other around said first rotor, said two additional rotors acting to substantially balance radial loads imposed on the first rotor.

15. The helical-screw rotary type compressor set forth in claim 13 wherein said at least one additional rotor comprises more than two additional rotors distributed substantially evenly around the first rotor, thereby substantially balancing radial loads imposed on the first rotor by the additional rotors.

16. The helical-screw rotary type compressor set forth in claim 11 further comprising a ball-bearing in the low pressure region rotationally supporting the shaft, said ball-bearing being cooled by the fluid after it leaks past the dynamic seal.

17. The helical-screw rotary type compressor set forth in claim 11 further comprising a ball-bearing in a region formed on an opposite side of said second wall, said ball-bearing rotationally supporting the shaft.

18. The helical-screw rotary type compressor set forth in claim 17 further comprising a second dynamic seal between said second wall and the shaft wherein said region formed on an opposite side of the second wall is a low pressure region and said ball-bearing is cooled by the fluid after it leaks past said second dynamic seal.

19. The helical-screw rotary type compressor set forth in claim 11 further comprising a ball-bearing in the enclosed annular space, said ball-bearing rotationally supporting the shaft, the ball-bearing being cooled by the fluid before it leaks past the dynamic seal.

20. The helical-screw rotary type compressor set forth in claim 11 wherein the first rotor is a male rotor and said at least one additional rotor comprise at least one female rotor, whereby said male rotor engages said at least one female rotor for compressing the fluid.

21. The helical-screw rotary type compressor set forth in claim 20 wherein the pitch diameters of the at least one female rotor is less than the pitch diameter of the male rotor.

22. The helical-screw rotary type compressor set forth in claim 11 further comprising ball bearings for rotationally supporting the shaft, said ball bearings taking up all remaining radial and axial loads on the shaft.

23. The helical-screw rotary type compressor set forth in claim 11 wherein said ball bearings are of the double-row angular contact ball type.

24. The helical-screw rotary type compressor set forth in claim 11 wherein said compressor is driven by a motor, said motor and compressor being hermetically sealed and said fluid is a working fluid of said compressor.

25. The helical-screw rotary type compressor set forth in claim 11 wherein said compressor is configured as an open-air type multi-rotor compressor, wherein said fluid is water and a ball-bearing is in the enclosed annular space, said ball-bearing rotationally supporting the shaft, the ball-bearing being cooled by the water before it leaks past the dynamic seal.

26. The helical-screw rotary type compressor set forth in claim 11 wherein said compressor is configured as an oil-less air compressor and the fluid is air being compressed.

* * * * *